US008934808B2

(12) United States Patent
Amemiya et al.

(10) Patent No.: US 8,934,808 B2
(45) Date of Patent: Jan. 13, 2015

(54) CHARGING DEVICE, INCLUDING A CLEANING DEVICE TO CLEAN A CHARGING ROLLER

(75) Inventors: Ken Amemiya, Tokyo (JP); Michiya Okamoto, Kanagawa (JP); Takuma Iwasaki, Kanagawa (JP); Shinya Karasawa, Kanagawa (JP); Yuta Azeyanagi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 220 days.

(21) Appl. No.: 13/272,918

(22) Filed: Oct. 13, 2011

(65) Prior Publication Data

US 2012/0107012 A1 May 3, 2012

(30) Foreign Application Priority Data

Nov. 1, 2010 (JP) ..... 2010-245154

(51) Int. Cl.
*G03G 21/00* (2006.01)
*G03G 15/08* (2006.01)
*G03G 15/02* (2006.01)

(52) U.S. Cl.
CPC ..... *G03G 15/0225* (2013.01)
USPC ..... 399/100

(58) Field of Classification Search
USPC ..... 399/100, 176
See application file for complete search history.

(56) References Cited

U.S. PATENT DOCUMENTS

| | | | |
|---|---|---|---|
| 6,873,809 | B2 | 3/2005 | Amemiya et al. |
| 7,949,281 | B2 | 5/2011 | Muraishi et al. |
| 8,000,627 | B2 | 8/2011 | Mizuishi et al. |
| 2002/0106212 | A1 | 8/2002 | Amemiya et al. |
| 2007/0286635 | A1 | 12/2007 | Matsui et al. |
| 2008/0124117 | A1 | 5/2008 | Muraishi et al. |
| 2009/0180795 | A1 | 7/2009 | Karasawa et al. |

FOREIGN PATENT DOCUMENTS

| | | | |
|---|---|---|---|
| CN | 1694010 | A | 11/2005 |
| CN | 101089744 | A | 12/2007 |
| JP | 04-076571 | A | 3/1992 |

(Continued)

OTHER PUBLICATIONS

Chinese Office Action dated Jan. 20, 2014 for corresponding Chinese Application No. 201110322747.5.

(Continued)

*Primary Examiner* — Quana M Grainger
(74) *Attorney, Agent, or Firm* — Harness, Dickey & Pierce P.L.C.

(57) ABSTRACT

A charging device, which is incorporable in a process cartridge and an image forming apparatus, includes a charging roller and a cleaning device. The charging roller charges an image bearing member having a surface on which an electrostatic latent image is formed. The cleaning device cleans the charging roller. The cleaning device includes a cleaning roller, a shaft, and support members. The cleaning roller contacts the surface of the charging roller to clean the surface. The support members rotatably support the cleaning roller, each of which including a slot. The slot allows a variable distance between the charging roller and the cleaning roller, and is inclined, in the direction of rotation of the charging roller, relative to a straight line connecting the rotation center of the charging roller and the rotation center of the cleaning roller.

14 Claims, 5 Drawing Sheets

(56) References Cited

FOREIGN PATENT DOCUMENTS

| | | | |
|---|---|---|---|
| JP | 5-297690 | A | 11/1993 |
| JP | 2002221883 | A | 8/2002 |
| JP | 2007-199326 | A | 8/2007 |
| JP | 2007193247 | A | 8/2007 |
| JP | 2007-333804 | A | 12/2007 |

OTHER PUBLICATIONS

Japanese Office Action dated Mar. 4, 2014 for corresponding Japanese Application No. 2010-245154.

Chinese Office Action dated Jul. 29, 2014 for corresponding Chinese Application No. 201110322747.5.

CHARGING DEVICE, INCLUDING A CLEANING DEVICE TO CLEAN A CHARGING ROLLER

CROSS-REFERENCE TO RELATED APPLICATIONS

The patent application is based on and claims priority pursuant to 35 U.S.C. §119 from Japanese Patent Application No. 2010-245154, filed on Nov. 1, 2010 in the Japan Patent Office, the entire disclosure of which is hereby incorporated by reference herein.

FIELD OF THE INVENTION

Embodiments of the present invention relate to a charging device, a process cartridge incorporating the charging device, and an image forming apparatus, such as a printer, a facsimile machine, and a multifunctional machine having the functions thereof, incorporating the charging device.

BACKGROUND OF THE INVENTION

In an electrophotographic image forming apparatus, a surface of a photoconductor serving as an image bearing member is charged with a charge of a predetermined polarity by discharge. The charged surface of the photoconductor is exposed to light to form an electrostatic latent image on the surface that is determined by image data. The electrostatic latent image is supplied with toner charged to the same polarity as the charge polarity to form a toner image. (Herein, toner charged to the same polarity as the charge polarity will be referred to as normally charged toner.) The toner image formed on the photoconductor is then transferred onto, for example, a recording sheet and fixed thereon by the application of heat and pressure.

After the transfer of the toner image, some of the toner having failed to be transferred remains on the surface of the photoconductor. Prior to the next charging process, therefore, the surface of the photoconductor is cleaned by cleaning members, such as a cleaning blade and a cleaning brush.

A known method of charging the surface of the photoconductor involves bringing a conductive charging roller into proximity to or contact with the surface of the photoconductor and a voltage is applied between the charging roller and the photoconductor in the proximity or contact state to charge the surface of the photoconductor. This arrangement has the advantage of reducing ozone production and power consumption. In recent years, therefore, such a charging device has been put to practical use in the image forming apparatus as described above.

However, if the post-transfer residual toner remaining on the surface of the photoconductor after the transfer of the toner image is not completely removed in the cleaning process and reaches an area in which the toner comes into proximity to or contact with the charging roller, the post-transfer residual toner adheres to the charging roller. The post-transfer residual toner includes so-called oppositely charged toner, which is not charged to the normal polarity but is charged to the opposite polarity. Although the normally charged toner electrostatically repels the charging roller, and thus hardly adheres to the surface of the charging roller, by contrast the oppositely charged toner electrostatically attracts the charging roller, and thus easily adheres to the surface of the charging roller. Moreover, in addition to the oppositely charged toner, any dust such as paper powder, for example, charged to electrostatically attract the charging roller adheres to the charging roller.

Further, in recent years, with an increase in demand for high-quality and high-definition images, a toner consisting of small-diameter spherical particles has come to be used in the development process. Such toner is designed to adhere more closely to the electrostatic latent image. By the same token, however, small-diameter spherical particles easily pass under the cleaning blade in the cleaning process, and thus tends to cause a cleaning failure. To prevent the toner not removed in the cleaning process and remaining on the photoconductor from adhering to the charging roller and obstructing uniform charging of the surface of the photoconductor, therefore, the surface of the charging roller should be thoroughly cleaned.

Related-art cleaning members for cleaning the charging roller include, for example, a sponge member formed of a material such as polyurethane foam and polyethylene foam, and a brush roller (as disclosed, for example, in Japanese Patent Application Publication No. 05-297690). Related-art cleaning members further include a cleaning roller formed by a metal shaft and a sponge or brush provided around the outer circumference of the shaft (as disclosed, for example, in Japanese Patent No. 3695696). Such a cleaning roller is pressed against the surface of the charging roller, and is rotated with the rotation of the charging roller, thereby removing deposits such as toner from the charging roller. Methods of pressing the cleaning member against the charging roller include a biasing method using biasing members such as springs and a biasing method using the weight of the cleaning member.

According to the biasing method using springs, it is possible to reliably press the cleaning member against the charging roller by adjusting the spring load. The method, however, uses biasing members such as springs, thus increasing the number of components. Further, if the cleaning member is left pressed against the charging roller for an extended period of time, the cleaning member tends to be permanently deformed, resulting in deterioration of cleaning performance.

With the biasing method using the weight of the cleaning member, the cost is reduced owing to fewer components. The pressure applied to the charging roller is adjusted by adjustment of the weight of the cleaning member. Specifically, to increase the contact pressure, the diameter of the shaft of the cleaning roller is increased. With demand in recent years for further reduction in both device size and cost, however, the cleaning roller is desired to be as thin as possible. Such a reduction in diameter of the cleaning roller results in insufficient contact pressure applied to the charging roller. As a result, the cleaning roller slips or bounces on the charging roller, and the cleaning effect is reduced.

To prevent the cleaning roller from bouncing, the cleaning device can be configured such that, in the inner wall of a hole formed in each of shaft supporting members for holding the cleaning roller, the contact resistance is reduced on the side close to the charging roller and increased on the side far from the charging roller (as disclosed, for example, in Japanese Patent Application Publication No. 2007-193247). If the contact resistance is increased enough to prevent the bouncing, however, the cleaning roller may be caught by the shaft supporting members and fail to return to the previous position after the bouncing.

BRIEF SUMMARY OF THE INVENTION

The present invention describes a novel charging device. In one example, a novel charging device includes a charging roller, a shaft, and a cleaning device. The charging roller is formed around the shaft and configured to charge an adjacent opposed image bearing member bearing an electrostatic latent image. The cleaning device is configured to clean the charging roller. The cleaning device cleans the charging roller and includes a cleaning roller and shaft supporting members. The cleaning roller is configured to contact and clean the surface of the charging roller. The shaft supporting members are configured to rotatably support the cleaning roller, and each of which includes a slot inclined, in the direction of rotation of the charging roller, relative to a straight line connecting the rotation center of the charging roller and the rotation center of the cleaning roller to allow a variable distance between the charging roller and the cleaning roller.

The angle of inclination of the slots in the direction of rotation of the charging roller may be less than approximately 90 degrees.

The cleaning roller may include a brush roller.

The cleaning roller may include a sponge roller.

The present invention further describes a novel process cartridge. In one example, a novel process cartridge includes the above-described charging device, which includes a charging roller configured to charge an image bearing member bearing an electrostatic latent image and a cleaning device configured to clean the charging roller.

The present invention further describes a novel image fanning apparatus. In one example, a novel image forming apparatus includes the above-described charging device, which includes a charging roller configured to charge an adjacent opposed image bearing member bearing an electrostatic latent image, and a cleaning device configured to clean the charging roller.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
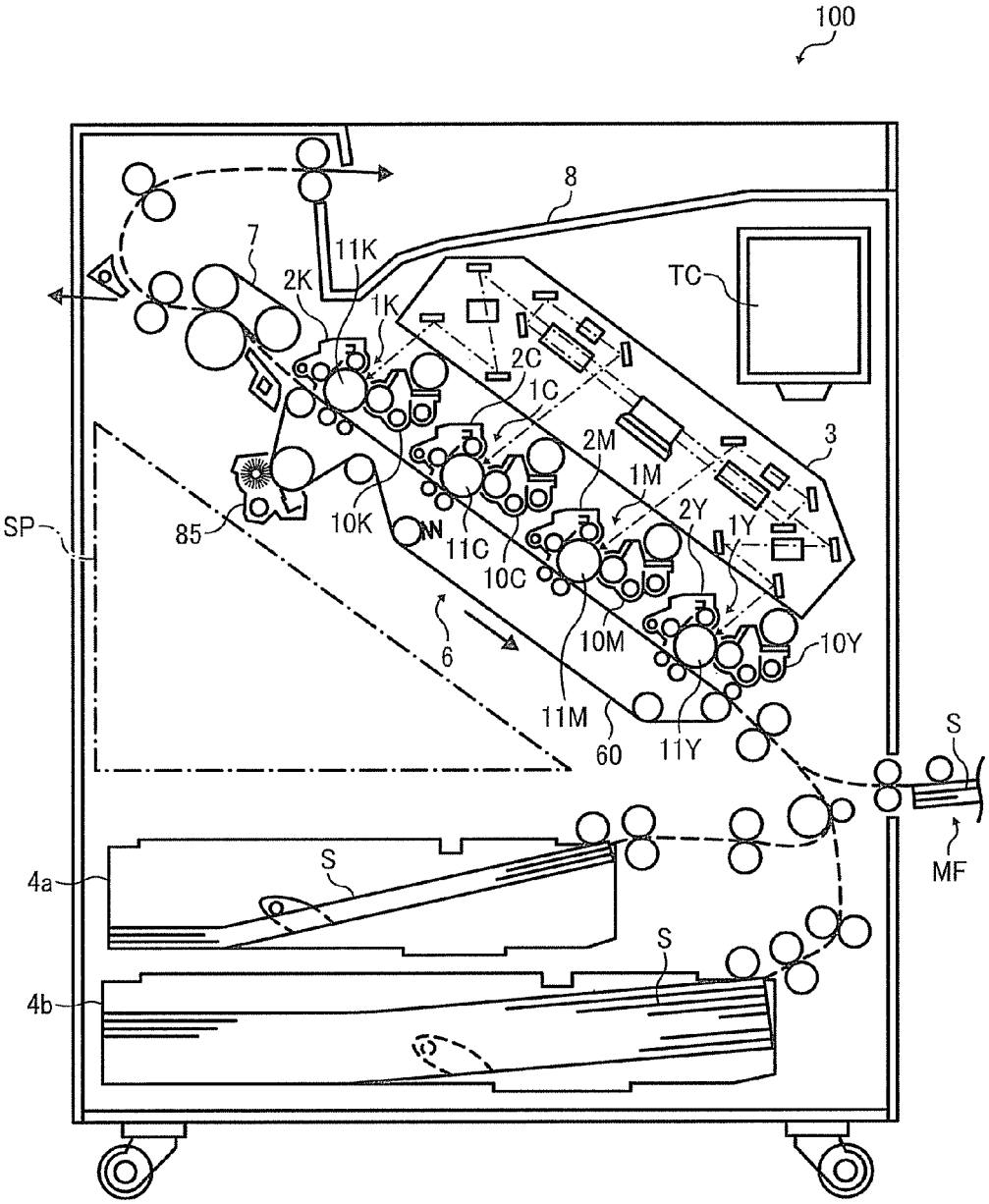
FIG. 1 is a schematic diagram illustrating an image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
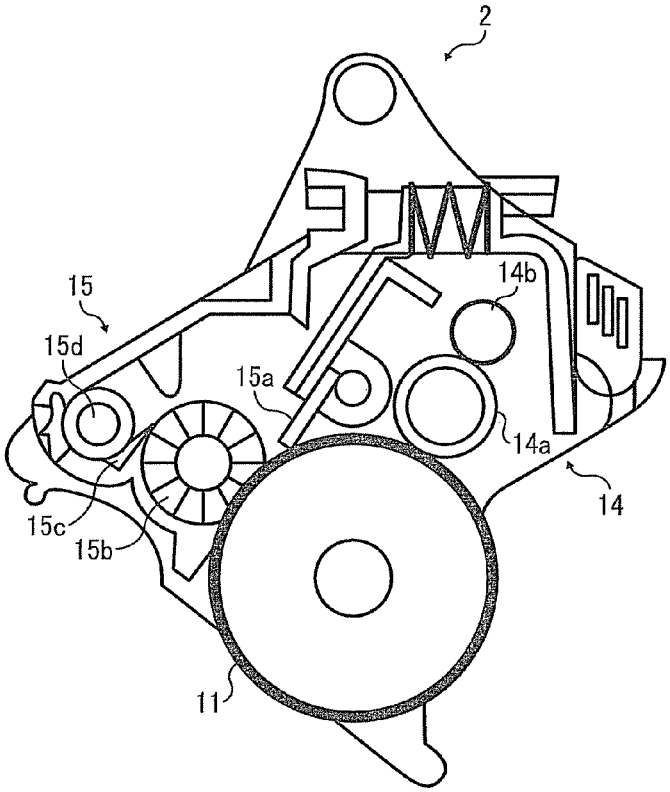
FIG. 2 is a diagram illustrating a photoconductor unit used in the image forming apparatus.

FIG. 1 is a diagram illustrating a schematic configuration of an image forming apparatus 100 according to an embodiment of the present invention. FIG. 2 is a diagram illustrating a schematic configuration of a photoconductor unit used in the image forming apparatus 100.

The image forming apparatus 100 illustrated herein includes four image forming units 1Y, 1M, 1C, and 1K for forming images of respective colors of yellow (Y), magenta (M), cyan (C), and black (K) (hereinafter referred to as Y, M, C, and K, respectively). The order of the colors Y, M, C, and K is not limited to the order illustrated in FIG. 1, and may be another order.

The image forming units 1Y, 1M, 1C, and 1K include photoconductor units 2Y, 2M, 2C, and 2K and development devices 10Y, 10M, 10C, and 10K, respectively. The photoconductor units 2Y, 2M, 2C, and 2K include photoconductor drums 11Y, 11M, 11C, and 11K, respectively, which serve as image bearing members. Each of the photoconductor units 2Y, 2M, 2C, and 2K includes a charging device 14 and a cleaning device 15 illustrated in FIG. 2. Further, the arrangement of the image forming units 1Y, 1M, 1C, and 1K is set such that the respective rotary shafts of the photoconductor drums 11Y, 11M, 11C, and 11K are parallel to one another, and that the image forming units 1Y, 1M, 1C, and 1K are arranged at predetermined intervals in the moving direction of a transfer sheet (i.e., recording medium).

Above the image forming units 1Y, 1M, 1C, and 1K, an optical writing unit 3 is provided. The optical writing unit 3 includes, for example, light sources, a polygon mirror, f-θ lenses, and reflecting mirrors, and applies laser light to the respective surfaces of the photoconductor drums 11Y, 11M, 11C, and 11K on the basis of image data while scanning the surfaces.

Below the image forming units 1Y, 1M, 1C, and 1K, a transfer unit 6 is provided. The transfer unit 6 serves as a belt driving device including a transfer conveying belt 60 which carries and conveys a transfer sheet to pass the transfer sheet through respective transfer portions of the image forming units 1Y, 1M, 1C, and 1K. On the outer circumferential surface of the transfer conveying belt 60, a cleaning device 85 including a brush roller and a cleaning blade is provided to be in contact with the outer circumferential surface. The cleaning device 85 removes foreign substances, such as toner, adhering to the transfer conveying belt 60.

On one side of the transfer unit 6, a fixing unit 7 according to a belt fixing method and a sheet discharge tray 8 are provided. In a lower part of the image forming apparatus 100, sheet feeding cassettes 4*a* and 4*b* accommodating transfer sheets S are provided. The image forming apparatus 100 also includes a manual feed tray MF for allowing transfer sheets S to be manually fed from a side surface of the image forming apparatus 100.

The image forming apparatus 100 further includes a toner replenishing container TC and a space SP indicated by a dash-dotted line and storing, for example, a waste toner bottle, a duplex reverse unit, and a power supply unit, which are not illustrated in the drawing.

The development devices 10Y, 10M, 10C, and 10K are similar in configuration and different only in color of toner used therein. The development devices 10Y, 10M, 10C, and 10K employ a two-component development method, and contain a developer including toner and magnetic carrier.

Each of the development devices 10Y, 10M, 10C, and 10K includes, for example, a development roller facing the corresponding one of the photoconductor drums 11Y, 11M, 11C, and 11K, a screw for conveying and stirring the developer, and a toner concentration sensor. The development roller includes a rotatable outer sleeve and a magnet fixed inside the sleeve. In accordance with the output from the toner concentration sensor, the development devices 10Y, 10M, 10C, and 10K are replenished with the toner from a toner replenishing device.

The photoconductor units 2Y, 2M, 2C, and 2K are similar in configuration, and are illustrated as a photoconductor unit 2 in FIG. 2. As illustrated in FIG. 2, the photoconductor unit 2 includes the photoconductor drum 11 bearing an electrostatic latent image, the charging device 14, and the cleaning device 15. The charging device 14 includes a charging roller 14*a* and a charging cleaning roller 14*b*.

The cleaning device 15 includes a cleaning blade 15*a*, a cleaning brush 15*b*, a scraper 15*c*, and a toner conveying auger 15*d*. The cleaning blade 15*a* and the cleaning brush 15*b* clean post-transfer residual toner remaining on the surface of the photoconductor drum 11. The scraper 15*c* is in contact with the cleaning brush 15*b* to remove the toner adhering to brush fiber. The toner scraped off by the cleaning blade 15*a* is moved toward the toner conveying auger 15*d* by the cleaning brush 15*b*. The toner conveying auger 15*d* is rotated to convey the collected waste toner to a not-illustrated waste toner storing unit.

Figure 3:
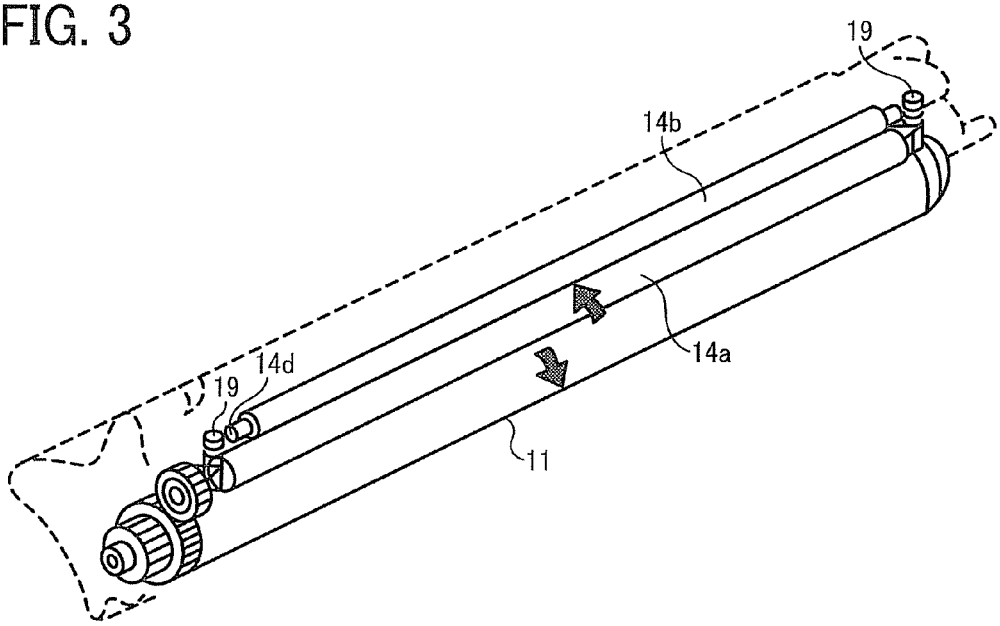
FIG. 3 is a perspective view illustrating a relationship of arrangement of a photoconductor drum, a charging roller, and a charging cleaning roller.

Subsequently, the charging device 14 will be described in detail. FIG. 3 is a perspective view illustrating a schematic configuration of the charging device 14 according to an embodiment of the present invention. The charging device 14 includes the charging roller 14*a* that serves as a charging member and is formed by a conductive bar core and a medium-resistance elastic layer covering the outer circumference of the bar core. The charging roller 14*a* is connected to a not-illustrated power supply, and is supplied with a predetermined voltage. The charging device 14 also includes pressure springs 19 serving as biasing members for biasing opposite end portions of the charging roller 14*a* against the photoconductor drum 11.

The charging roller 14*a* may be provided in contact with the photoconductor drum 11. In the present embodiment, however, the charging roller 14*a* is separated by a minute gap formed between the charging roller 14*a* and the photoconductor drum 11. Although not illustrated, the minute gap may be set by, for example, spacer members having a predetermined thickness and wrapped around non-image forming areas in the opposite end portions of the charging roller 14*a*, with the respective surfaces of the spacer members contacting the surface of the photoconductor drum 11.

The charging roller 14*a* is provided with a cleaning device for preventing the charging roller 14*a* from being stained with the post-transfer residual toner remaining on the surface of the photoconductor drum 11 after the cleaning of the photoconductor drum 11. The cleaning device of the present embodiment includes the charging cleaning roller 14*b* that serves as a cleaning roller. The charging cleaning roller 14*b* may be formed as a so-called sponge roller, which includes a core member and, for example, open-cell resin foam wrapped into a cylindrical shape or molded around the outer circumference of the core member. Alternatively, the charging cleaning roller 14*b* may be formed as a so-called brush roller, which includes a core member and brush-like fibers wrapped into a cylindrical shape or electrostatically implanted around the outer circumference of the core member.

Figure 4A:
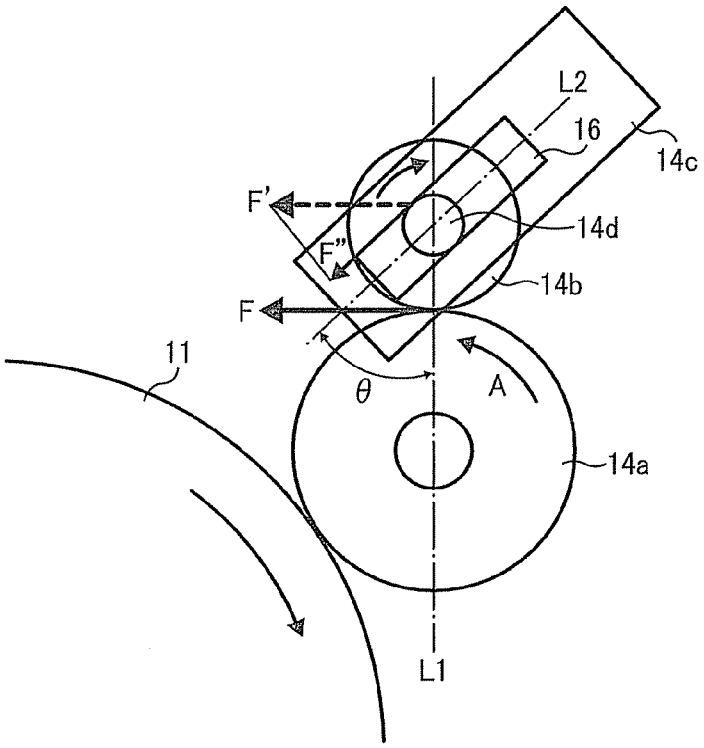
FIG. 4A is a diagram for explaining a configuration of a cleaning device for a charging roller according to an embodiment of the present invention.

As illustrated in FIG. 4A, the charging cleaning roller 14*b* is rotatably supported by shaft supporting members 14*c* having slots 16 formed therein. The slots 16 formed in the shaft supporting members 14*c* allow a variable distance between the charging cleaning roller 14*b* and the charging roller 14*a* as a member to be cleaned. The charging cleaning roller 14*b* thus rotatably supported by the shaft supporting members 14*c* contacts the surface of the charging roller 14*a* owing to the weight of the charging cleaning roller 14*b*. Thereby, the charging cleaning roller 14*b* is pressed against the charging roller 14*a*. Namely, the charging cleaning roller 14*b* contacts the surface of the charging roller 14*a* with a predetermined pressure due to a force in a direction of gravity that is generated by the own weight of the charging cleaning roller 14*b*.

The charging cleaning roller 14*b* is rotated with the rotation of the charging roller 14*a* in the direction indicated by arrow A. Thus moved in accordance with the rotation of the charging roller 14*a*, the charging cleaning roller 14*b* does not require a driving device. Consequently, the configuration is simplified.

The shaft supporting members 14*c* are not limited to the shape as illustrated above. For example, the shaft supporting members 14*c* can be formed in a different shape or structure to rotatably support the charging cleaning roller 14*b* at end portions in an axial direction of the charging cleaning roller 14*b*. Alternatively, the shaft supporting members 14*c* can be formed in another shape or structure to support the shaft supporting members 14*c* by respective side walls of the photoconductor unit 2 (i.e., the photoconductor units 2Y, 2M, 2C, and 2K) where the charging cleaning roller 14*b* are accommodated.

Figure 4B:
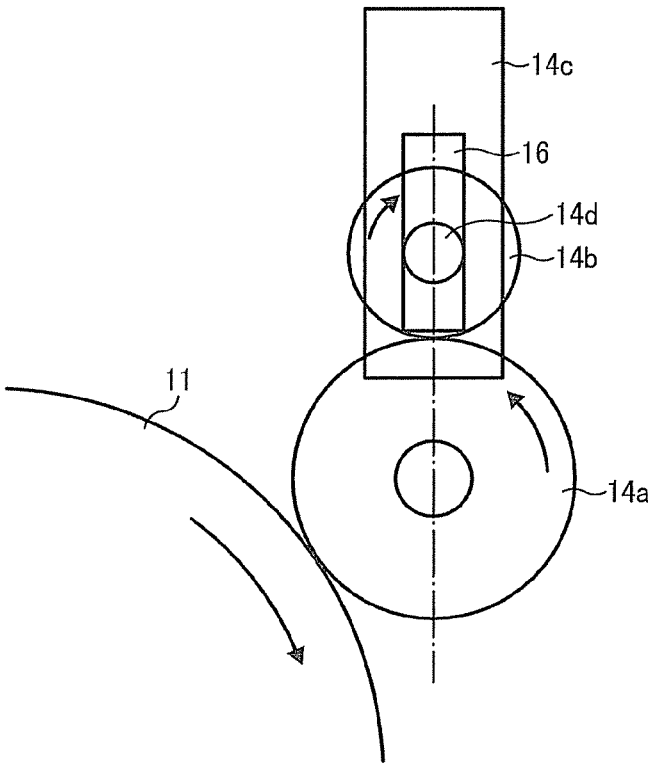
FIG. 4B is a diagram for explaining a configuration of a comparative example of a cleaning device for a charging roller.

To further an understanding of the present disclosure, FIG. 4B illustrates a configuration of a comparative example of a cleaning device. As illustrated in FIG. 4B, a straight line extending in the longitudinal direction of the above-described slots 16 is directed toward the center of the charging roller 14*a*. Therefore, the pressure applied to the charging roller 14*a* by the charging cleaning roller 14*b* relies solely on the weight of the charging cleaning roller 14*b* and the force of springs.

If the pressure is reduced below a certain critical threshold, the charging cleaning roller 14*b* slips or bounces on the charging roller 14*a*, and cleaning performance deteriorates. In the case of a configuration using the pressure generated by the weight of the charging cleaning roller 14*b*, therefore, the charging cleaning roller 14*b* has a certain weight. Such a configuration prevents a reduction in diameter of a shaft 14*d* of the charging cleaning roller 14*b*, and thus presents an obstacle to reduction in size and cost of the charging device.

According to the present embodiment, therefore, the slots 16 of the shaft supporting members 14*c*, which allow a variable distance between the charging cleaning roller 14*b* and the charging roller 14*a*, are configured as follows, as illustrated in FIG. 4A.

A straight line L2 is parallel to the longitudinal direction of the slots 16, and a straight line L1 connects the rotation center of the charging roller 14*a* and the rotation center of the charging cleaning roller 14*b*. The straight line L2 is inclined at an angle θ relative to the straight line L1 in the direction of rotation of the charging roller 14*a* immediately after passage through the point of contact between the charging roller 14*a* and the charging cleaning roller 14*b*. When the charging roller 14*a* is rotated, therefore, a tangential force F is generated between the charging roller 14*a* and the charging cleaning roller 14*b*, and a force F' acting in the same direction as the direction of the tangential force F is generated in the charging cleaning roller 14*b* by the action of the tangential force F. Further, a component force F" is generated along the shaft supporting members 14*c* serving as supporting members. Thereby, a component of pressure acting toward the charging roller 14*a* is generated. The force component F" generated by the force F' (hereinafter referred to as pressing force F") and acting toward the axis of the charging roller 14*a* can be expressed as $F''=\frac{1}{2}F' \sin 2\theta$ $(0<\theta<\pi/2)$.

With this configuration, it is possible to reduce the weight of the charging cleaning roller 14*b*. That is, it is possible to reduce the diameter of the shaft 14*d* of the charging cleaning roller 14*b*, and thus to reduce the overall diameter of the charging cleaning roller 14*b*. Accordingly, reduction in size and cost is attained. It is to be noted that the angle θ is less than approximately 90 degrees.

Instead of using the weight of the charging cleaning roller 14*b*, the force of a spring or springs pressing the charging cleaning roller 14*b* can be used. In this case, when the above-described shaft supporting members 14*c* are used, a relatively small constant is required to the spring(s), thereby enhancing a reduction in cost.

As described above, the pressing force F" can be expressed as a function of the angle θ formed by the straight line L2 parallel to the longitudinal direction of the slots 16 and the straight line L1 passing through the rotation center of the charging roller 14*a* and the rotation center of the charging cleaning roller 14*b*. Further, as described above, the straight line L2 parallel to the longitudinal direction of the slots 16 (i.e., a center line in the drawing) is inclined at the angle θ relative to the straight line L1, which connects the rotation center of the charging roller 14*a* and the rotation center of the charging cleaning roller 14*b*, in the direction of rotation of the charging roller 14*a*. This inclination affects the tangential force F generated between the charging roller 14*a* and the charging cleaning roller 14*b*, when the charging roller 14*a* is rotated. Further, the straight line L2 is inclined in the direction of rotation immediately after the passage through the point of contact between the charging roller 14*a* and the charging cleaning roller 14*b*. In FIG. 4A, the straight line L2 is inclined in a lower left direction.

It is possible to adjust the pressing force of the charging cleaning roller 14*b* to a desired value by appropriately adjusting the coefficient of kinetic friction between the charging roller 14*a* and the charging cleaning roller 14*b* and the above-described angle θ in accordance with such factors as the material forming the surface of the charging cleaning roller 14*b*, the weight of the rotary shaft 14*d* (e.g., metal shaft) of the charging cleaning roller 14*b*, and the material forming the surface of the charging roller 14*a*. Thereby, cleaning performance is adjusted, and charging performance and therefore also image quality are both improved.

With the above-described configuration, it is possible to reduce the weight of the charging cleaning roller 14*b*, i.e., to reduce the diameter of the shaft 14*d* of the charging cleaning roller 14*b*. It is therefore possible to reduce the diameter of the charging cleaning roller 14*b*. Accordingly, reduction in size and cost is attained.

Figure 5:
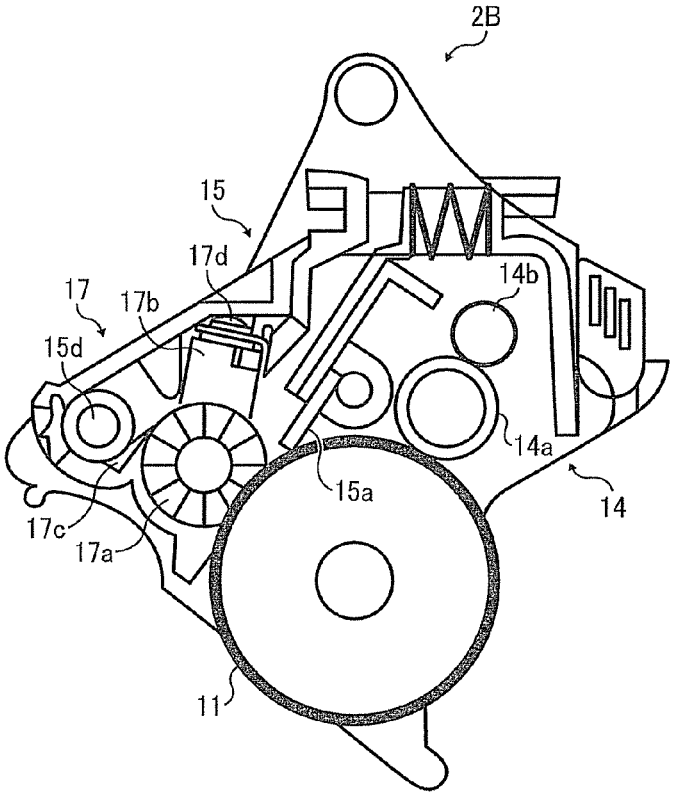
FIG. 5 is a diagram illustrating a photoconductor unit according to another embodiment of the present invention.

FIG. 5 illustrates a photoconductor unit 2B according to another embodiment of the present invention. The photoconductor unit 2B includes a lubricant application device 17 that applies a lubricant to the photoconductor drum 11. The photoconductor unit 2B is similar in configuration to the photoconductor unit 2 illustrated in FIG. 2, except for the presence of the lubricant application device 17.

The lubricant application device 17 mainly includes a solid lubricant 17*b*, a brush roller 17*a*, a brush roller scraper 17*c*, and a pressure spring 17*d*. The brush roller 17*a* contacts the solid lubricant 17*b*, and scrapes and supplies the solid lubricant 17*b* to the surface of the photoconductor drum 11. The brush roller scraper 17*c* removes toner adhering to the brush roller 17*a*. The pressure spring 17*d* presses the solid lubricant 17*b* against the brush roller 17*a* with predetermined pressure.

The solid lubricant 17*b*, which is molded into a block shape, includes fatty acid metallic salts, such as lead oleate, zinc oleate, copper oleate, zinc stearate, cobalt stearate, iron stearate, copper stearate, zinc palmitate, copper palmitate, and zinc linolenate, and fluorine-based resins, such as polytetrafluoroethylene, polychlorotrifluoroethylene, polyvinylidene fluoride, polytrifluorochlorethylene, dichlorodifluoroethylene, tetrafluoroethylene-ethylene copolymer, and tetrafluoroethylene-oxafluoropropylene copolymer.

The brush roller 17*a* has a shape extending in the axial direction of the photoconductor drum 11. The pressure spring 17*d* is biased toward the brush roller 17*a* so that the solid lubricant 17*b* can be substantially completely exhausted. The solid lubricant 17*b* is expendable, and thus is reduced in thickness over time. The solid lubricant 17*b*, however, is applied with pressure by the pressure spring 17*d*. Therefore, the solid lubricant 17*b* is constantly kept in contact with the brush roller 17*a*. Thereby, the brush roller 17*a* scrapes the solid lubricant 17*b*, and supplies and applies the solid lubricant 17*b* to the photoconductor drum 11. Herein, the brush roller 17*a* also serves as a cleaning brush, and functions to move the toner scraped off by the cleaning blade 15*a* toward the toner conveying auger 15*d*.

The lubricant application device 17 is not limited to the above-described configuration. For example, the lubricant application device 17 may be configured to bring the solid lubricant 17*b* into direct contact with the surface of the photoconductor drum 11 to apply the solid lubricant 17*b* to the surface, or may be configured to supply a powder lubricant to the surface of the photoconductor drum 11.

With the provision of the lubricant application device 17 that applies a lubricant to the surface of the photoconductor drum 11, the coefficient of friction of the surface of the photoconductor drum 11 is reduced. Thereby, the adhesion of the toner adhering to the surface of the photoconductor drum 11 is reduced, and the transfer performance of transferring the developed toner image is improved. Further, the cleaning performance of the cleaning blade 15*a* cleaning the residual toner remaining on the surface of the photoconductor drum 11 after the transfer process is improved. The lubricant application device 17 is particularly advantageous in a configuration using a toner having small-diameter spherical particles. With the above-described configuration, the residual toner remaining on the surface of the photoconductor drum 11 is favorably cleaned. It is therefore possible to reduce stains on the surface of the charging roller 14*a*, and thus to extend the life of the charging cleaning roller 14*b*.

Figure 6:
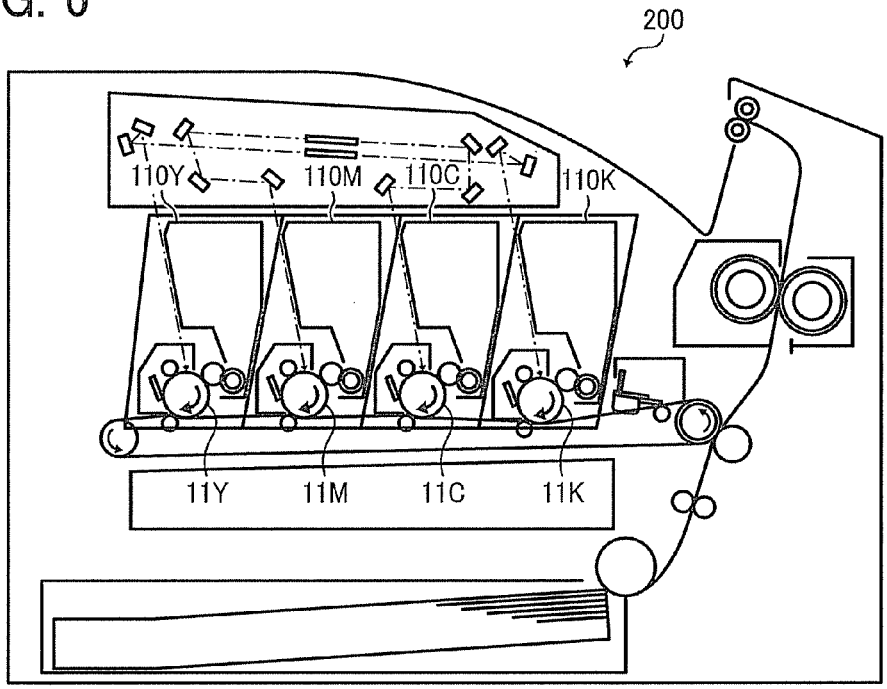
FIG. 6 is a schematic diagram illustrating an image forming apparatus according to another embodiment of the present invention.

FIG. 6 is a schematic configuration diagram illustrating an image forming apparatus 200 according to another embodiment of the present invention. The image forming apparatus 200 illustrated in FIG. 6 includes four image forming units 110Y, 110M, 110C, and 110K for forming images of the respective colors of Y, M, C, and K. The image forming units 110Y, 110M, 110C, and 110K include the photoconductor drums 11Y, 11M, 11C, and 11K, respectively, which serve as image bearing members. Further, each of the image forming units 110Y, 110M, 110C, and 110K includes a charging device, a development device, and a cleaning device.

Figure 7:
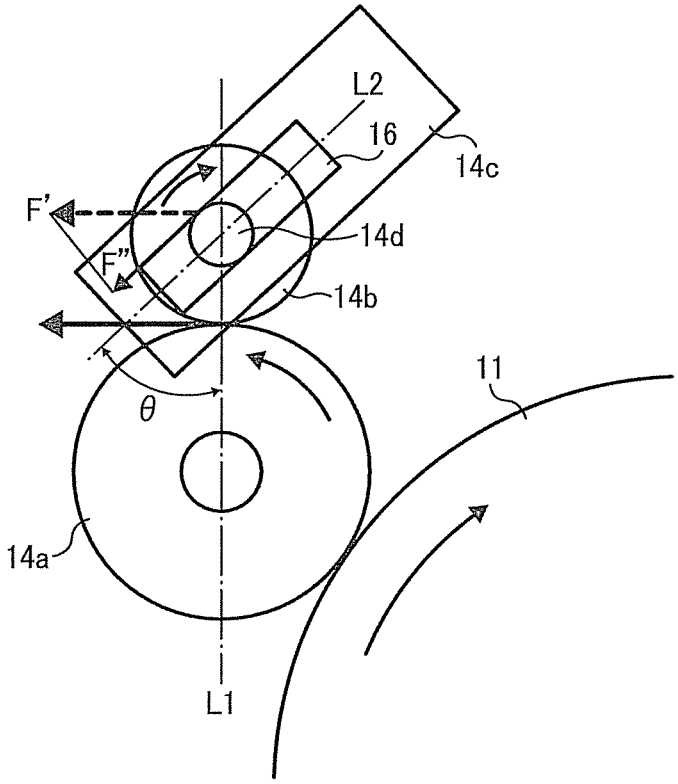
FIG. 7 is a diagram for explaining a configuration of a cleaning device for a charging roller used in the image forming apparatus illustrated in FIG. 6.

In the image forming apparatus 200 having the above-described configuration, the photoconductor drum 11, the charging roller 14*a*, and the charging cleaning roller 14*b* have a positional relationship as illustrated in FIG. 7. That is, the charging roller 14*a* is located on the upper left side of the photoconductor drum 11, and the charging cleaning roller 14*b* is located directly on the charging roller 14*a*.

Also in the present image forming apparatus 200, the straight line L2 parallel to the longitudinal direction of the slots 16 of the shaft supporting members 14*c* is inclined at the angle θ relative to the straight line L1, which connects the rotation center of the charging roller 14*a* and the rotation center of the charging cleaning roller 14*b*, in the direction of rotation of the charging roller 14*a* immediately after the passage through the point of contact between the charging roller 14*a* and the charging cleaning roller 14*b*.

With this configuration, the pressing force F" is added to the weight of the charging cleaning roller 14*b*, and thus reduction in size and cost of the charging device is attained, similarly as in the foregoing embodiment.

Preferred embodiments of the prevent invention have been described above. The present invention, however, is not limited to the above-described embodiments. For example, according to the present invention, the charging cleaning roller 14*b* comes into contact with the charging roller 14*a*, and increases the pressing force thereof by using the force acting in the tangential direction. The present invention, therefore, is not limited to the above-described embodiments in which the charging cleaning roller 14*b* is brought into contact with the charging roller 14*a* by the weight of the charging cleaning roller 14*b*. The present invention is also applicable to a configuration in which the charging cleaning roller 14*b* is located vertically below the charging roller 14*a* and brought into contact with the charging roller 14*a* by the use of the pressing force of, for example, springs. In this case, it is possible to use springs having the same size but a smaller spring constant, and thus to reduce the cost.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A charging device, comprising:

a charging roller configured to charge an adjacent opposed image bearing member bearing an electrostatic latent image; and a cleaning device configured to clean the charging roller, the cleaning device including:

a cleaning roller configured to contact and clean the surface of the charging roller;

a shaft around which the cleaning roller is formed; and supporting members to rotatably support the shaft of the cleaning roller, the supporting members include a slot such that the shaft of the cleaning roller moves within the slot in a direction that is inclined with respect to a straight line that connects a rotation center of the charging roller and a rotation center of the cleaning roller to allow a variable distance between the charging roller and the cleaning roller, wherein an angle of inclination of the slot is an angle inclined in the direction of rotation of the charging roller after passing through a point of contact between the charging roller and the cleaning roller, and the angle of inclination of the slot in the direction of rotation of the charging roller is less than approximately 90 degrees.

2. The charging device according to claim 1, wherein the cleaning roller contacts the charging roller under its own weight.

3. The charging device according to claim 1, wherein the cleaning roller includes a brush roller.

4. The charging device according to claim 1, wherein the cleaning roller includes a sponge roller.

5. A process cartridge, comprising the charging device according to claim 1, which includes a charging roller configured to charge an adjacent opposed image bearing member bearing an electrostatic latent image, and a cleaning device configured to clean the charging roller.

6. An image forming apparatus, comprising the charging device according to claim 1, which includes a charging roller configured to charge an adjacent opposed image bearing member bearing an electrostatic latent image, and a cleaning device configured to clean the charging roller.

7. The charging device according to claim 1, wherein the cleaning roller configured to contact a surface of the charging roller with a set pressure due to a force in a direction of gravity that is generated by the own weight of the cleaning roller.

8. The charging device according to claim 1, wherein the cleaning roller is configured to rotate via a rotation of the charging roller.

9. The charging device according to claim 1, wherein when the charging roller is rotated, a tangential force F is generated between the charging roller and the cleaning roller, and a force F' acting in the same direction as a direction of the tangential force F is generated in the cleaning roller by the action of the tangential force F.

10. The charging device according to claim 9, wherein the supporting members generates a component force F" when the force F' is generated.

11. The charging device according to claim 10, wherein the force component F", generated by the force F' and acting toward an axis of the charging roller, is defined by $F''=\frac{1}{2}F' \sin 2\theta$ $(0<\theta<\pi//2)$.

12. The charging device according to claim 10, wherein the component force F" is a function of an angle θ formed by the direction of movement of the shaft of the cleaning roller in the slot with respect to a straight line that connects a rotation center of the charging roller and a rotation center of the cleaning roller.

13. The charging device according to claim 1, wherein the pressing force of the cleaning roller is adjusted to a desired value by adjusting a coefficient of kinetic friction between the charging roller and the cleaning roller.

14. The charging device according to claim 13, wherein the coefficient of kinetic friction between the charging roller and the cleaning roller is determined in accordance with at least one of a material forming the surface of the cleaning roller, weight of the shaft of the cleaning roller, and material forming the surface of the charging roller.

* * * * *